United States Patent [19]

Matsuda

[11] Patent Number: 4,909,234

[45] Date of Patent: Mar. 20, 1990

[54] CUTTER

[75] Inventor: Yusaku Matsuda, Yamatokoriyama, Japan

[73] Assignee: Sanwa Diamond Industrial Co., Ltd., Japan

[21] Appl. No.: 361,503

[22] Filed: Jun. 5, 1989

[30] Foreign Application Priority Data

Jun. 9, 1988 [JP] Japan ..... 63-143296

[51] Int. Cl.[4] ..... B24D 5/00; B28D 1/04

[52] U.S. Cl. ..... 125/15; 51/209 R

[58] Field of Search ..... 51/207, 209 R, 206 R; 125/15, 20, 22; 83/840, 843

[56] References Cited

U.S. PATENT DOCUMENTS 3,049,843 8/1962 Christensen ..... 125/15

FOREIGN PATENT DOCUMENTS 0107861 6/1984 Japan ..... 125/15

0152376 7/1986 Japan ..... 125/15

*Primary Examiner*—D. S. Meislin

*Assistant Examiner*—Bruce P. Watson

*Attorney, Agent, or Firm*—Ostrolenk, Faber, Gerb & Soffen

[57] ABSTRACT

A cutter comprises a ring-shaped base plate. On the peripheral edge of the base plate there are formed a plurality of projections interposing slits therebetween. The projections are formed thinner than the base plate and provided with holes, through which wires are passed to connect the projections. Furthermore, around the projections, a ring-shaped cutting body is formed. The cutting body includes abrasive grains and is formed to expose a portion of slits.

5 Claims, 2 Drawing Sheets

CUTTER

BACKGROUND OF THE INVENTION

1. Field of the Invention

The present invention relates to a cutter, particularly, it relates to a cutter used when cutting such as stones.

2. Description of the Prior Art

FIG. 4 is a plan view showing an example of a conventional cutter which is a background of the present invention, and FIG. 5 is a sectional view taken along the line V—V of the cutter shown in FIG. 4 The cutter 1 comprises a ring-shaped base plate 2. On the peripheral edge of the base plate 2, there are formed a plurality of projections 4 interposing slits therebetween. Furthermore, around the projections 4 of the peripheral edge of the base plate 2, a ring-shaped cutting body 5 is formed. The cutting body 5 is formed by sintering a metal powder including abrasive grains such as diamond particles. The cutting body 5 is formed such that a portion of slits 3 is exposed. The slits 3 serve to cool the cutter 1 with air when in use.

When using the cutter 1, it is placed against an object to be cut while rotating so that the object to be cut is cut by the cutting body 5. At this time, abrasions take place gradually on the cutting body 5 to expose its inner portion, thereby the sharpness of the cutter 1 is maintained.

In such a conventional cutter, however, if the thickness of the projections is made relatively thick, the projections hardly wear on use of the cutter As a result, the new inner portion of the cutting body is hindered by the projections to be exposed on the surface, thus degrading the cutter sharpness.

Also, since the mechanical strength of the cutting body formed at the slits is weak, there were incidences when the cutting body breaks at the slits.

SUMMARY OF THE INVENTION

It is therefore a primary object of the present invention to provide a cutter which hardly breaks and whose sharpness is not degraded on use.

The present invention is directed to a cutter comprising, a ring-shaped base plate, a plurality of projections formed thinner than the base plate on the peripheral edge thereof and provided with holes and slits interposed therebetween, wires passing through the holes so as to connect the projections, and a ring-shaped cutting body including abrasive grains and formed around the projections so as to expose a portion of slits.

Since the projections are formed thin, abrasions easily take place thereon on use of the cutter. Furtheremore, the cutting body at the slits is reinforced by the wires connecting the projections.

According to the present invention, it is possible to obtain a cutter which hardly breaks and whose sharpness is not degraded on use.

These and other objects, features and advantages of the present invention will become more apparent from the following detailed description of the embodiment made with reference to the accompanying drawings.

DESCRIPTION OF THE PREFERRED EMBODIMENT

Figure 1:
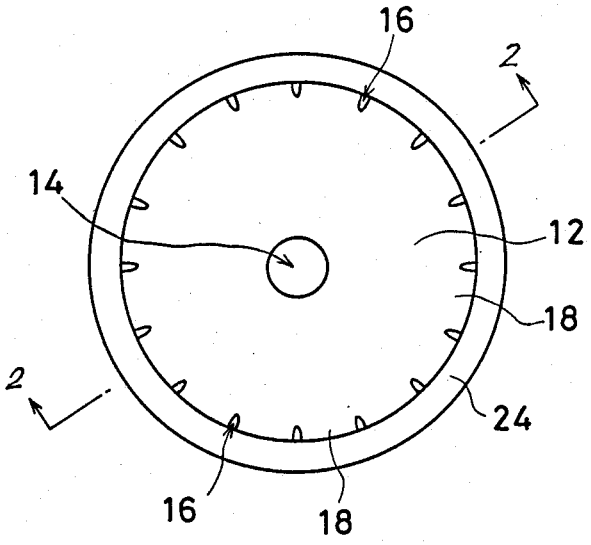
FIG. 1 is a plan view showing an embodiment of the present invention.
Figure 2:
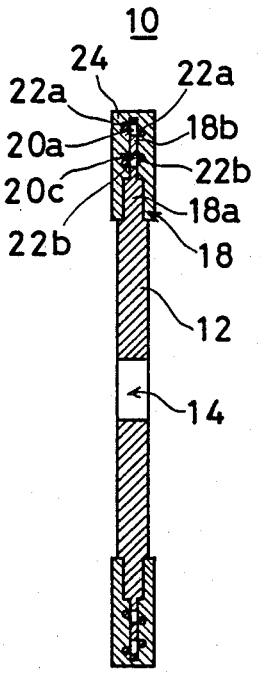
FIG. 2 is a sectional view taken along the line II—II of the embodiment of FIG. 1.

FIG. 1 is a plan view showing an embodiment of the present invention, and FIG. 2 is a sectional view taken along the line II—II of the embodiment of FIG. 1 A cutter 10 comprises a base plate 12, which is formed by such as stainless steel into a ring shape. In the center portion of the base plate 12, a through hole 14 for inserting a shaft (not shown) for holding the cutter 10 is formed.

Figure 3:
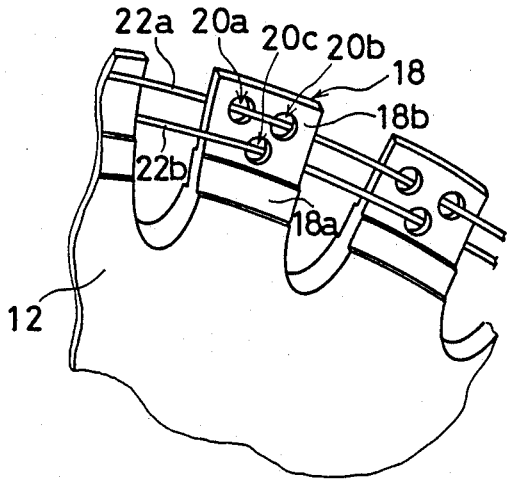
FIG. 3 is a perspective view of an essential portion of a cutter shown in FIG. 1.
Figure 4:
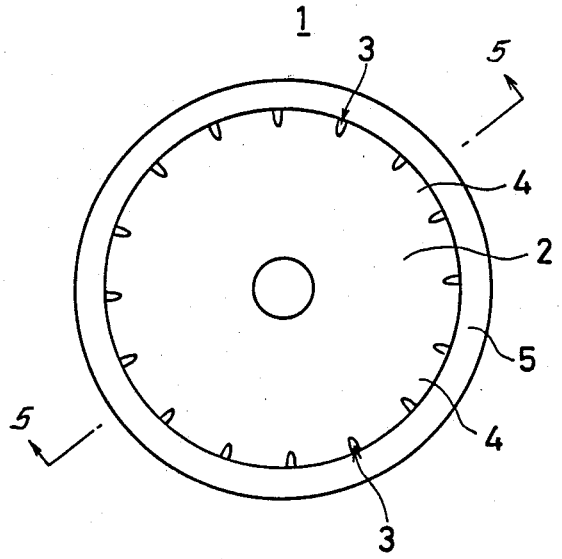
FIG. 4 PRIOR ART
FIG. 4 is a plan view showing an example of a conventional cutter which is a background of the present invention.
Figure 5:
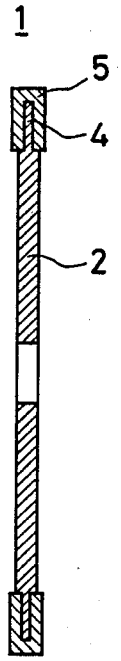
FIG. 5 PRIOR ART
FIG. 5 is a sectional view taken along the line V—V of a conventional cutter shown in FIG. 4.

On the peripheral edge of the base plate 12, a plurality of projections 18 interposing slits 16 therebetween are formed. The projection 18 includes a root portion 18*a* which is thinner than the base plate 12 and a tip portion 18*b* which is thinner than the root portion 18*a*. The tip portion 18*b* of the projection 18 is formed into the thickness of, for example, about 0.2 mm. As shown in FIG. 3, in the tip portion 18*b* of the projection 18, three holes 20*a*, 20*b* and 20*c* are formed. The holes 20*a* and 20*b* are formed and aligned on the peripheral side of the tip portion 18*b* of the projection 18, and the hole 20*c* is formed on the side of root portion 18*a*. These holes 20*a*, 20*b* and 20*c* are formed to have a diameter of, for example, 1–1.5 mm. Through the holes 20*a*, 20*b* and 20*c*, two wires 22*a* and 22*b* are passed to connect a plurality of projections 18 thereby. One of the wires 22*a* is passed through the holes 20*a* and 20*b* to connect the projections 18, and the other wire 22*b* is passed through the hole 20*c* to connect the projections 18. As the wires 22*a* and 22*b*, for example, a stainless wire a piano wire and a copper wire etc. are used.

Meanwhile, a ring-shaped cutting body 24 is formed around the projections 18. The cutting body 24 is formed in such a manner that, a ring-shaped compressed powder formed by compressing a mixture of, for example, 1–50% diamond particles, 30–50% copper particles, 30–50% iron particles and 5–10% tin particles by volume percent is arranged around the projections 18 and sintered. At this time, as the compressed powder is penetrated into the holes 20*a*, 20*b* and 20*c*, the cutting body 24 is secured firmly to the projections 18. Since the root portion 18*a* of the projection 18 is formed thicker than the tip portion 18*b*, the strength of the forming portion of the cutting body 24 is intensified. It is to be understood that the cutting body 24 is formed so as to expose a portion of the slits 16. By exposing the slits 16, the cutter 10 is cooled with air at its rotation.

When using the cutter 10, it is placed against an object to be cut such as stones while rotating, thereby the object to be cut is cut by the cutting body 24.

In the cutter 10, since the tip portion 18*b* of the projection 18 is formed thinner, it is subject to abrasions on use of the cutter 10. As a result, the tip portion 18*b* of the projection 18 also wears as the abrasion takes place on the cutting body 24, thus allowing the new inner portion of the cutting body 24 to expose on the surface. Accordingly the sharpness of the cutter 10 can be maintained.

Furtheremore, since the plurality of projections 18 are connected by the wires 22*a* and 22*b*, which present in the slits 16 to reinforce the cutting body 24. Particularly, if a copper wire is used as the wires 22*a* and 22*b*, which will fuse together with a copper powder contained in a raw material of the cutting body 24 at sintering to secure the wires 22*a* and 22*b* to the cutting body 24 firmly. Accordingly, the cutting body 24 formed at the slits 16 is difficult to break. As such, in the cutter 10, the sharpness is not degraded and it is difficult to break as compared with the conventional cutter.

In the embodiment described above, though three holes 20*a*, 20*b* and 20*c* are formed at the tip portion 18*b* of the projection 18, the number of holes may be changed arbitrarily.

Furthermore, in the embodiment described above, though diamond particles are employed as abrasive grains used in the cutting body 24, the abrasive grains such as cubic boron nitride (CBN) may be used besides.

While the present invention has been particularly described and illustrated, it is to be understood that such description is for illustrative purposes and by way of example and not of limitation. The spirit and scope of the present invention, therefore, is to be determined solely by the appended claims.

What is claimed is:

1. A cutter comprising, a ring-shaped base plate;

a plurality of projections formed thinner than said base plate on the peripheral edge thereof, and provided with holes and slits interposed therebetween;

wires passing through said holes so as to connect said projection; and a ring-shaped cutting body including abrasive grains and formed around said projections so as to expose a portion of said slits.

2. A cutter in accordance with claim 1, wherein said projections are formed thinner than said base plate at its root portion, and its tip portion is formed thinner than said root portion.

3. A cutter in accordance with claim 1, wherein said wires are formed by a stainless wire, a piano wire or a copper wire.

4. A cutter in accordance with claim 1, wherein said abrasive grains are diamond particles.

5. A cutter in accordance with claim 1, wherein said abrasive grains are cubic boron nitride.

* * * * *